United States Patent [19]

Garnier, Sr.

[11] 4,097,068

[45] Jun. 27, 1978

[54] FEED-BACK COMMUNICATION CARD

[76] Inventor: Robert C. Garnier, Sr., 9611 W. Lorraine Pl., Milwaukee, Wis. 53222

[21] Appl. No.: 732,371

[22] Filed: Oct. 14, 1976

[51] Int. Cl.[2] ..... B42D 15/00

[52] U.S. Cl. ..... 283/5; 283/48 R; 35/48 R; 235/490

[58] Field of Search ..... 283/48, 5, 23; 35/48 A, 35/48 R; 235/61.12 R

[56] References Cited

U.S. PATENT DOCUMENTS

| | | | |
|---|---|---|---|
| 496,965 | 5/1893 | White | 283/5 |
| 1,404,611 | 1/1922 | Hoag | 283/5 |
| 2,177,106 | 10/1939 | Harper | 235/61.12 R |
| 3,708,656 | 1/1973 | Fielder | 235/61.12 R |
| 3,943,642 | 3/1976 | Sokoloski | 35/48 R |
| 3,966,232 | 6/1976 | Doriel | 283/23 |

*Primary Examiner*—Stephen C. Pellegrino

*Attorney, Agent, or Firm*—Andrus, Sceales, Starke & Sawall

[57] ABSTRACT

Feed-back communication cards for ascertaining the views of participants in a meeting or conference in which pull off tabs are enhanced with ink marks on the edge and face of the edge of each card so that when a multiplicity of the cards are stacked, the openings in the card edges resulting from the removal of the pull off tabs and the ink markings on face of the card edges providing for quickly determining the outcome of the views of the assembly participants and a reliable estimate of the number who expressed themselves on the issue or issues which have been presented.

2 Claims, 5 Drawing Figures

FEED-BACK COMMUNICATION CARD

BACKGROUND OF THE INVENTION

The invention provides a set of feed-back communication cards which can be readily manipulated by participants at a meeting to remove portions thereof to record their views, such as attitude, concern, or evaluation, or vote upon the issues selected so that when the cards are collected and stacked, the teller, speaker or the like can, for example, visually observe the openings on the edges of the cards to quickly determine the predominance of views on the issue presented and the approximate number of views which have been recorded by the stacked cards. The cards of the invention in many cases eliminate the necessity of counting each and every vote on an issue.

SUMMARY OF THE INVENTION

The invention is directed to the use of feed-back communication cards having a portion which sets forth the issues upon which the views of the members of the meeting can be expressed and, in one embodiment, a second portion having a space for respective users to provide information. On the two sides and end of the first portion are located a plurality of tabs which are scored for ready removal. The bases of the members ordinarily terminate in inked lines which overlap the edge of each card so that when the cards are stacked to tabulate the views expressed, the inked marks form columns and outline the faces of the edges of the cards within which spaces appear which are formed when the tabs are removed from each card. The bordering inked lines and the spaces quickly indicate the predominant view of the assembly, and the approximate number of votes which have been cast can also be readily tabulated.

DESCRIPTION OF THE EMBODIMENTS ILLUSTRATED IN THE DRAWINGS

Figure 1:
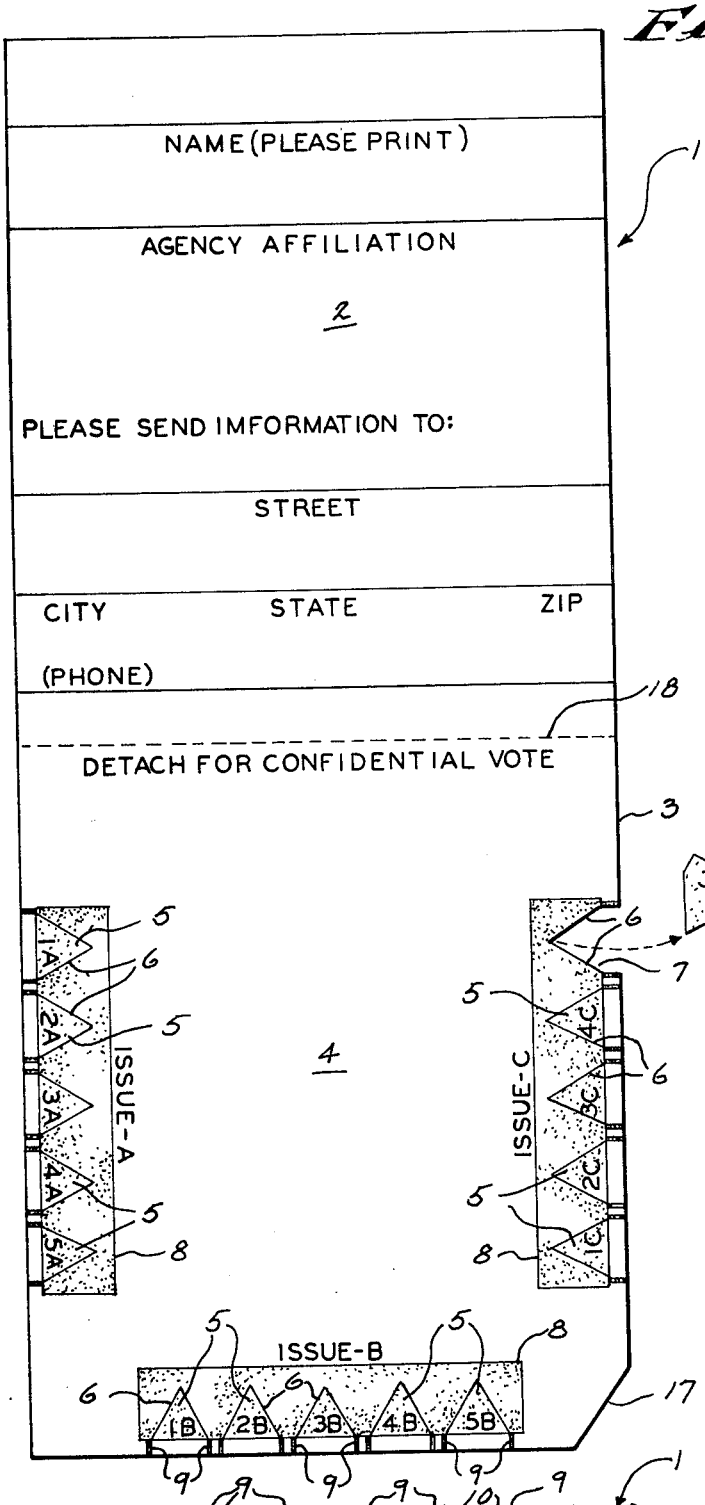
FIG. 1 is a top plan view of the tabulating card of the invention.

Referring to the drawings, there is shown in FIG. 1 a typical feed-back communication card 1 which at the upper end portion 2, as shown in the drawing, contains identifying information of each participant at a conference or meeting. The lower end portion 3 in the center 4 is provided for inserting the polling or survey type of information upon which the views of the meeting are to be taken. The card is very versatile in that it may be placed in the coat pocket of personnel at a meeting to expose the identifying information of the bearer and later used to obtain information on the issue presented to the meeting.

The lower end portion 3 along the three sides of the card contains a plurality of triangular shaped tabs or members 5, as illustrated in FIG. 1, which are scored or perforated along the edges as at 6 so that they can easily be removed to form notches or openings on the face of the edge of card 1, as illustrated by the notch 7 in FIG. 1, from which a triangular member 5 has been removed.

The number of triangular shaped members 5 may be varied depending upon the number of issues to be polled and the size and shape of the card. For purposes of illustration, a series of triangular shaped members have been illustrated in FIG. 1 on both sides and the lower end of card 1 and have been numbered 1A through 5A, 1B through 5B, and 1C through 5C, inclusive.

Triangular shaped members 5 are normally bordered by a section 8 which may be colored like members 5 but differently than the card itself to stand out from the remainder of the card and, of course, many different colors may be used. In addition, card 1 may be printed with numerous issues to be passed upon. In the example there is listed issue A, issue B and issue C which has not necessarily been described in space 4.

Figure 5:
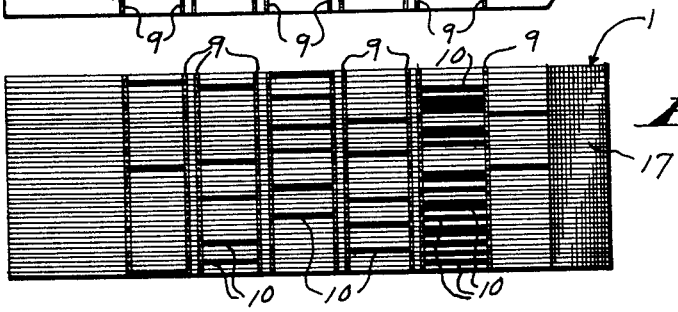
FIG. 5 is an end view of a plurality of cards of FIG. 1 which have been stacked to indicate the views expressed on the issue or issues.

The extreme edge and edge face of each card 1 at the meeting base ends of triangular members 5 are provided with a pair of spaced ink marks 9 which overlap the face of the edge of card 1 so that when cards 1 are stacked, as illustrated in FIG. 5, ink marks 9 form columns and clearly outline the spaces or notches 10 in the face of the edges of card 1 which show up in the stacked cards after members 5 have been removed. By spaces 10 and the bordering marks 9 a tabulator can readily observe the winning or predominant views on the issue presented and also is able to make a quick estimate of the actual views expressed on the issue.

Figure 2:
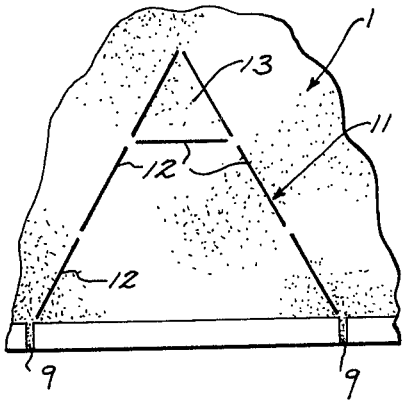
FIG. 2 is an enlarged view of a removable triangular shaped member which is removable from the card to cast a vote and having means to readily remove the member.

The enlarged triangular member 11 shown in FIG. 2 which may be used in card 1, is scored horizontally and intermittently secured to card 1 as at 12 and a small triangular shaped tab or member 13 at the upper end portion of member 11 is similarly scored and can be forced out with a pencil or the like so that tab 11 may be readily removed by the voter through the use of the pencil. The described ink marks 9 are also shown on the face of the edge of the card 1 illustrated in FIG. 2.

Figure 3:
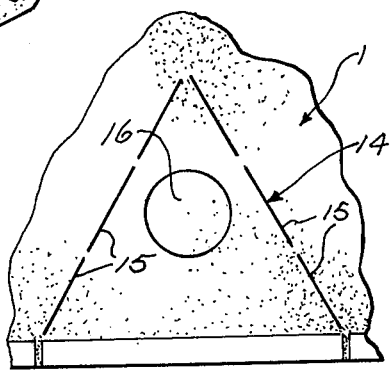
FIG. 3 is similar to FIG. 2 but with a different construction for removal of the triangular shaped members.

The enlarged triangular tab or member 14 shown in FIG. 3 is intermittently scored and secured to card 1 as at 15. A center circular piece 16 is also scored and can be readily forced out by a pencil or the like so that triangular tab 14 may be easily removed through the use of the pencil. The described ink marks 9 are also shown on the face of the edge of card 1 illustrated in FIG. 4.

A standard angle 17 is provided on card 1 by removal of one of the corners, such as at the lower end of card 1, to permit fool-proof and fast stacking of the cards for visual viewing and counting.

In FIG. 1 there is illustrated a scored or perforated horizontal line 18 about midway of card 1 so that in the event it is desired to have a confidential expression of views, the lower portion 3 of the card may be separated from the upper portion 1 upon which the name and address of the participant appears.

In some cases there may not be any printing on the lower end portion 3 of card 1 or even if there is, a speaker in the midst of setting forth various proposals to a meeting or conference can quickly obtain the views of those present by having each person, by way of example, indicate "yes" by pulling out tab 5 marked 5A, "no" by pulling out the tab 5 marked 1A and "no opinion" by pulling tab 5 marked 3A.

Figure 4:
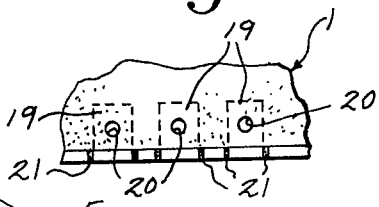
FIG. 4 is a detail view of another embodiment of the invention.

Tabs or members 5 can be of any shape such as triangular, square or rectangular which would expose an opening in the face of each card when tab 5 is removed. In FIG. 4 there is shown scored tabs 19 of rectangular shape disposed in card 1 which have a small hole 20 therein for ready removal by inserting the end of a pencil or pen into hole 20. This embodiment also has the bordering ink lines 21 on the edge and face of the edge of card 1. The appearance of the stacked cards would be similar to that shown in FIG. 5.

Cards 1 are die cut and can be stacked in almost any practical numbers to expose the markings, openings and/or recesses as viewed in FIG. 5 and the bordering ink markings.

The described cards provide a way for those running a meeting or speaking at it to obtain a fast communication of the views of those present before, during or after a presentation of the issue or various issues under consideration.

Various modes of carrying out the invention are contemplated as being within the scope of the following claims particularly pointing out and distinctly claiming the subject matter which is regarded as the invention.

I claim:

1. Feed-back communication cards to ascertain the views in a meeting of participants, which comprises on the face of the card and at least along one edge thereof a plurality of scored members with the elongated base of each member facing outwardly to effect ready removal of the scored members and leave an elongated space along the facing edge of each card upon removal so that when the cards are stacked the spaces can readily be observed to determine the predominant views of the meeting and quickly provide at least an approximate number of the views expressed on the issue, the base of each scored member being slightly horizontally spaced from the base of each adjacent scored member to provide a spaced area therebetween, and ink marks extending over the extreme edge and edge face of each card in the spaced area between the scored members and horizontally spaced from each other to thereby border each side of a column of assembled card edges within which the spaces appear to readily indicate that the scored members have been removed and for visual tabulation of the views expressed by those present.

2. The feed-back communcation cards of claim 1 and the scored members being bordered by a color different than the card itself so that the location of the scored members will visually stand out from the remainder of each card and other corresponding cards.

* * * * *